US006776114B2

(12) United States Patent
Abe

(10) Patent No.: US 6,776,114 B2
(45) Date of Patent: Aug. 17, 2004

(54) SMALL CRAFT

(75) Inventor: Tomohisa Abe, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/224,386

(22) Filed: Aug. 21, 2002

(65) Prior Publication Data

US 2003/0047124 A1 Mar. 13, 2003

(30) Foreign Application Priority Data

Aug. 28, 2001 (JP) ..... 2001-257307

(51) Int. Cl.[7] ..... B63B 3/00
(52) U.S. Cl. ..... 114/88; 114/219; 114/357
(58) Field of Search ..... 114/219, 85, 88, 114/343, 352–357, 361, 364; 293/102, 120, 126–128, 136

(56) References Cited

U.S. PATENT DOCUMENTS 3,019,758 A * 2/1962 Erkert ..... 114/219
3,065,724 A * 11/1962 Tritt ..... 114/88
3,133,294 A * 5/1964 Kunz ..... 114/357
3,315,284 A * 4/1967 Ludlow ..... 114/357
3,827,092 A * 8/1974 Butler ..... 114/357
3,831,990 A * 8/1974 Singh et al. ..... 293/1
3,871,043 A * 3/1975 Davidson et al. ..... 114/356
3,897,967 A * 8/1975 Barenyi ..... 293/120
4,292,913 A * 10/1981 Siebert et al. ..... 114/219
4,627,373 A * 12/1986 Nishida ..... 114/182
4,803,944 A * 2/1989 Roberson ..... 114/359
4,861,530 A * 8/1989 Zaccaria ..... 264/408
4,903,629 A * 2/1990 Maudlin et al. ..... 114/361
5,149,569 A * 9/1992 McCue ..... 428/31
5,171,499 A * 12/1992 Cehelnik et al. ..... 264/151
5,184,564 A * 2/1993 Robbins et al. ..... 114/345
5,743,203 A * 4/1998 NcNamara ..... 114/85
5,743,206 A * 4/1998 Hattori ..... 114/55.51
5,829,378 A * 11/1998 Nunes et al. ..... 114/219
6,349,662 B1 * 2/2002 Limansky et al. ..... 114/219

* cited by examiner

*Primary Examiner*—S. Joseph Morano
*Assistant Examiner*—Ajay Vasudeva
(74) *Attorney, Agent, or Firm*—Birch, Stewart, Kolasch & Birch, LLP

(57) ABSTRACT

To enhance the joint strength between the hull and the deck of a water craft and reduce the number of steps needed for joining the hull and the deck, a water craft body is constructed by joining the hull and the deck together at their peripheral regions, applying a protector strip of extruded material to the joint between the hull and the deck peripherally of the water craft body and installing fasteners, such as self-tapping screws or rivets, through the protector strip and through the peripheral regions of the hull and deck for integrating the protector strip and the peripheral regions of the hull and the deck. Formed in the outer surface of the protector strip is a positioning groove that facilitates locating the positions of fasteners about the peripheral joint between the hull and the deck of the water craft.

15 Claims, 6 Drawing Sheets

(b)

SMALL CRAFT

BACKGROUND OF THE INVENTION

CROSS-REFERENCE TO RELATED APPLICATIONS

The present application claims priority under 35 U.S.C. 119 of Japanese Patent Application No. 2001-257307 filed on Aug. 28, 2001, the entire contents thereof being hereby incorporated by reference.

1. Field of the Invention

This invention relates to a small craft. More specifically, the present invention relates to a small water craft in which the vessel body is constructed by joining a hull and a deck at their peripheral edges with respect to each other 2. Description of Background Art Heretofore, as shown in FIG. 6, a small craft has been constructed with a vessel body in which a hull 1 and a deck 2 are joined (for example, adhered by adhesive agent) at their peripheral edges 1*a*, 2*a*, and a rail-shaped side protector 3, or protector strip, is attached on the periphery thereof.

In the small craft as described above, in order to enhance the joint between the hull 1 and the deck 2 that constitute the vessel body 4, their peripheral edges 1*a*, 2*a* are preferably joined with each other using fasteners such as self-tapping screws or rivets. In addition, in order to reduce the number of assembling steps, it is preferable to join the protector strip 3 together with the peripheral edges 1*a*, 2*a* of the hull 1 and the deck 2 with the aforementioned self-tapping screws or rivets.

In the case where the protector strip 3 and the peripheral edges 1*a*, 2*a* of the hull and deck are joined together by means of the self-tapping screws or the rivets, it is necessary to determine the positions of the fasteners, and this is conventionally done by forming a positioning hole 3*b* on the outer surface 3*a* of the protector strip 3 at the suitable position in the X-direction (widthwise direction of the protector strip 3) and in the Y-direction (lengthwise direction of the protector strip 3) as shown in FIG. 6(*b*). When employing a self-tapping screw, it can be driven into the positioning hole 3*b* with its tip aligned thereon, while rivets can driven into the through hole by placing the tip of a drilling tool (a drill or the like) on the positioning hole 3*b* to form a through hole (a hole extending through the protector strip 3 and the peripheral edges 1*a*, 2*a* of the hull and the deck) and driving the rivet therein.

However, forming positioning holes 3*b* for self-tapping screws or rivets on the outer surface 3*a* of the protector strip 3 for every fastener position requires a large number of steps.

SUMMARY AND OBJECTS OF THE INVENTION

An object of the present invention is to solve the problem described above, and to provide a small craft in which the hull and deck can be firmly joined and the protector strip can also be attached by a small number of steps, and the locations for self-tapping screws or rivets can be marked on the protector strip by a small number of steps.

In order to achieve the aforementioned object, a small craft is constructed by the steps of joining a hull and a deck at the peripheral edges thereof with respect to each other, placing a rail-shaped side protector, or protector strip, circumferentially thereof, and integrating the protector strip and the peripheries of the hull and the deck with self-tapping screws or rivets; the protector strip is formed with a positioning groove for the self-tapping screws or the rivets on the outer surface thereof along the length thereof.

Also, to achieve the aforementioned object, the protector strip is advantageously formed of extruded material.

Since the vessel body is constructed by joining the hull and the deck at the peripheral edges thereof, placing the protector strip circumferentially thereof, and integrating the protector strip and the peripheral edges of the hull and the deck with self-tapping screws or rivets, the joint between the hull and the deck can be strengthened, and the protector strip can be attached with a small number of steps.

Since the protector strip is formed with a positioning groove for the self-tapping screws or the rivets on the outer surface thereof along the length thereof, the locations for the self-tapping screws or the rivets can be marked on the protector strip by a smaller number of steps compared to marking the locations without the benefit of the positioning groove. (See the reference numeral and sign 3*b* in FIG. 6(*b*).)

In other words, with the protector strip of the present invention, locations for the self-tapping screws or the rivets can be determined simply along the length of the positioning groove.

Though simply forming the positioning groove along the length of the protector strip does not ensure high accuracy of the spacing, or intervals, of the self-tapping screws or the rivets installed through the protector strip along the length thereof, the accuracy of the intervals of the self-tapping screws or the rivets driven along the length thereof will not be a problem in terms of the construction of the vessel body. In other words, the high positional accuracy of the locations for the self-tapping screws or the rivets is required in the widthwise direction of the protector strip, and the widthwise positions for the self-tapping screws or the rivets can be set out with a high degree of accuracy using the protector strip of the present invention.

Thus, the hull and the deck can be firmly joined, and simultaneously the protector strip can be attached thereon with a small number of steps, and furthermore, the locations for the self-tapping screws or the rivets may be determined on the protector strip with a smaller number of steps.

Since the protector strip is formed of extruded material, the positioning groove can be formed simultaneously with extrusion. Therefore, it is not necessary to form the positioning groove for the self-tapping screw or the rivets after manufacturing the protector strip.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4(*b*) is a cross sectional view, taken at another location, showing the integrated structure of the peripheral edges of the hull 14 and the deck 15 with respect to each other;

FIG. 5(*b*) is a side view of the protector strip as shown in FIG. 4(*a*);

FIG. 5(*c*) is a partially enlarged view of a portion of FIG. 4(*a*);

FIG. 6(*b*) shows a positioning hole in a prior art side protector.

DETAILED DESCRIPTION OF THE PREFERRED EMBODIMENTS

Figure 1:
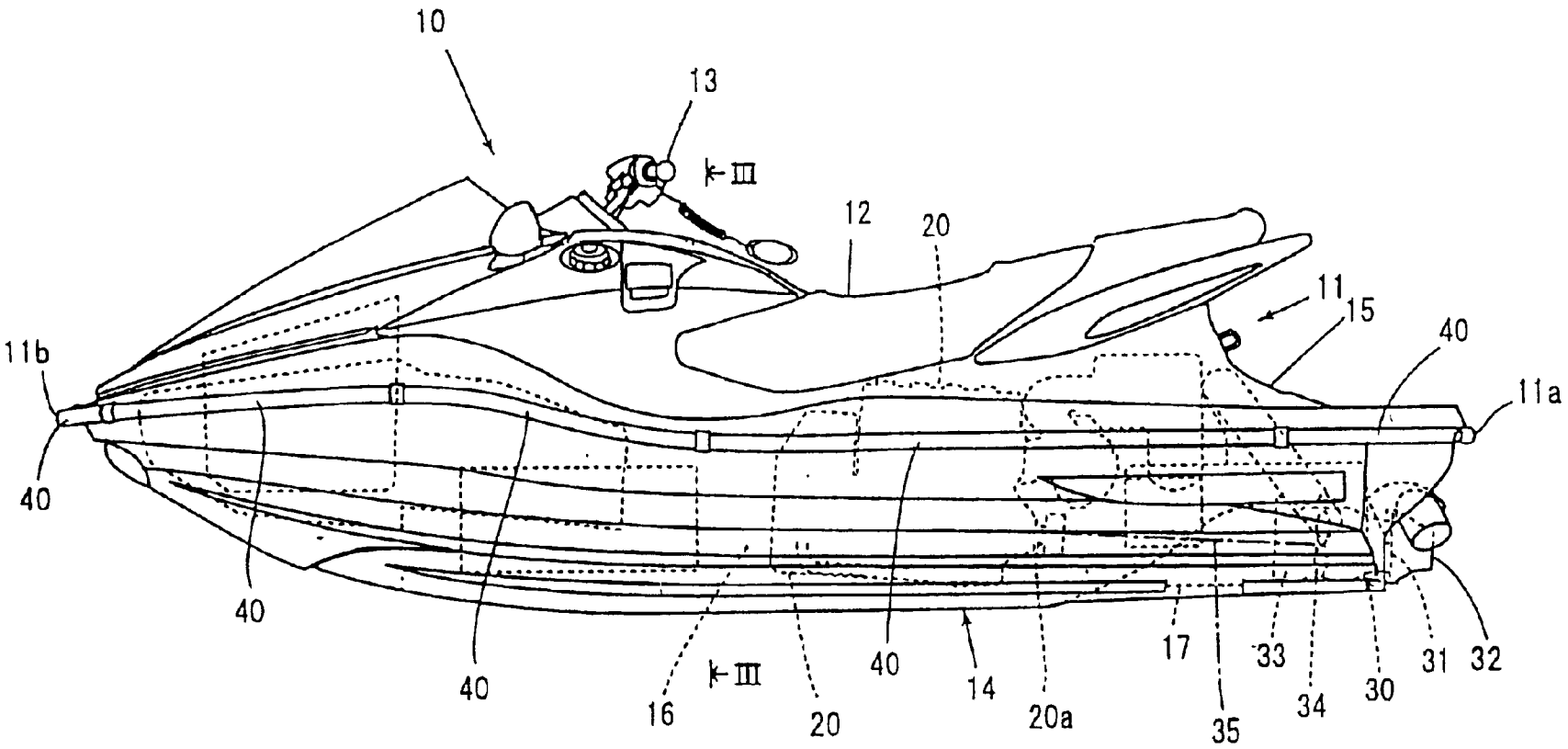
FIG. 1 is a general side view showing an embodiment of the small craft according to the present invention.
Figure 2:
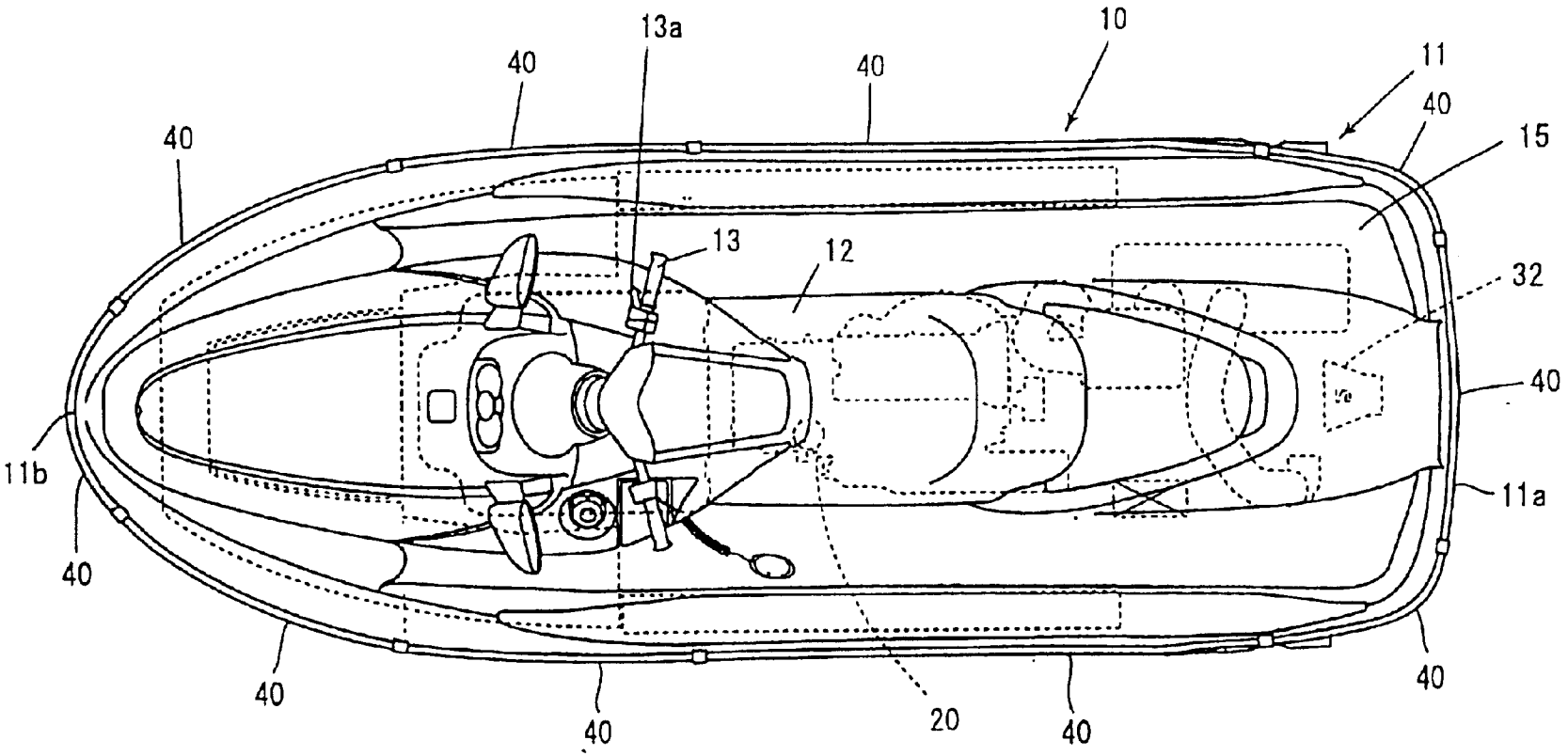
FIG. 2 is a plan view of the small craft of FIG. 1.
Figure 3:
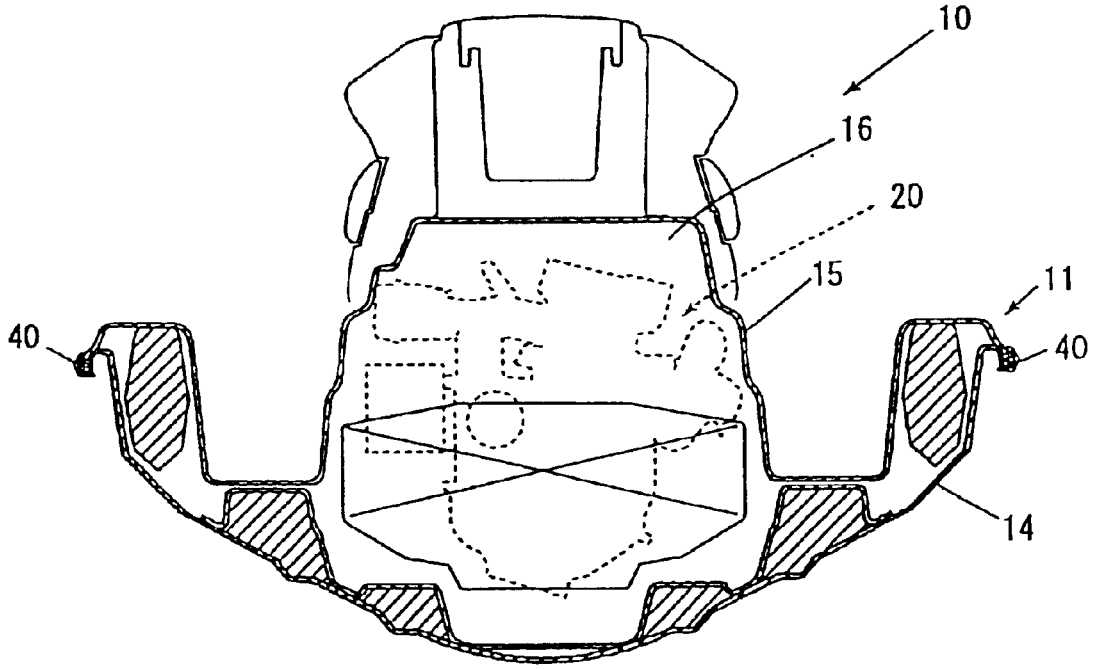
FIG. 3 is an enlarged, partially omitted, cross sectional view taken along the line III—III in FIG. 1.

FIG. 1 is a general side view showing an embodiment of a small craft according to the present invention, FIG. 2 is a plan view of the same, and FIG. 3 is a partially enlarged cross sectional view taken along the line III—III in FIG. 1 (partially omitted cross sectional view).

As shown in these figures (mainly in FIG. 1), the small water craft 10 according to this embodiment is a saddle-riding type small boat, in which the occupant can sit on the seat 12 on the vessel body 11 and steer with the steering handle 13 with a throttle lever gripped.

The vessel body 11 is a floating structure formed by joining a hull 14 and a deck 15 so as to form a space 16 therein. In the space 16, an engine 20 is mounted on the hull 14, and a jet pump 30 serving as a propulsion means and driven by the engine 20 is mounted on the rear portion of the hull 14.

The jet pump 30 comprises a flow path 33 extending from a intake port 17 opening at the vessel bottom to the a jet flow port 31 and a nozzle 32 opening at the rear end of the vessel body, and an impeller 34 disposed in this flow path 33, and the shaft 35 of the impeller 34 is connected to the output shaft 20*a* of the engine 20. Therefore, when the impeller 34 is rotated by the engine 20, water taken through the intake port 17 is forced through the jet flow port 31 and nozzle 32, whereby the vessel body 11 is propelled. The speed of the engine 20, that is, a propulsion force of the jet pump 30 is varied by rotating the throttle lever 13*a* (See FIG. 2) of the operating handle 13. The nozzle 32 is linked with the operating handle 13 with an operating wire, not shown, and rotated by the operation of the handle 13, thereby changing the course.

Figure 4A:
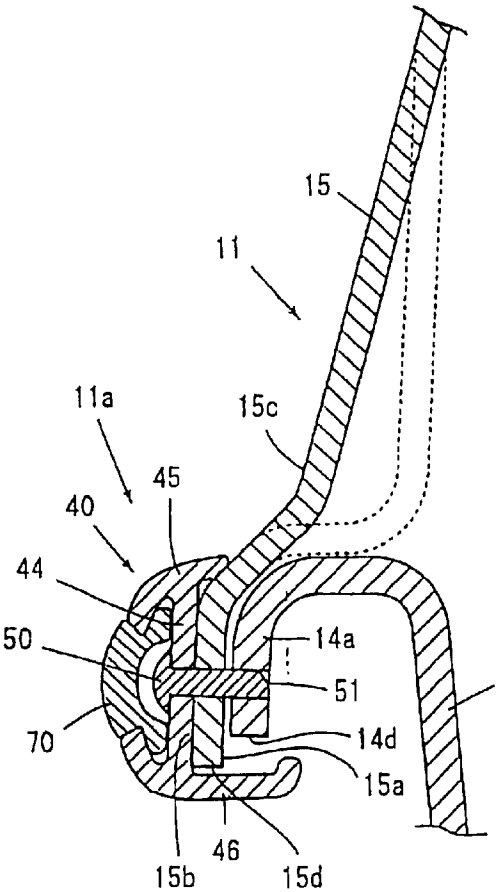
FIG. 4(*a*) is a cross sectional view showing the integrated structure of the peripheral edges of the hull 14 and the deck 15 with respect to each other.
Figure 4B:
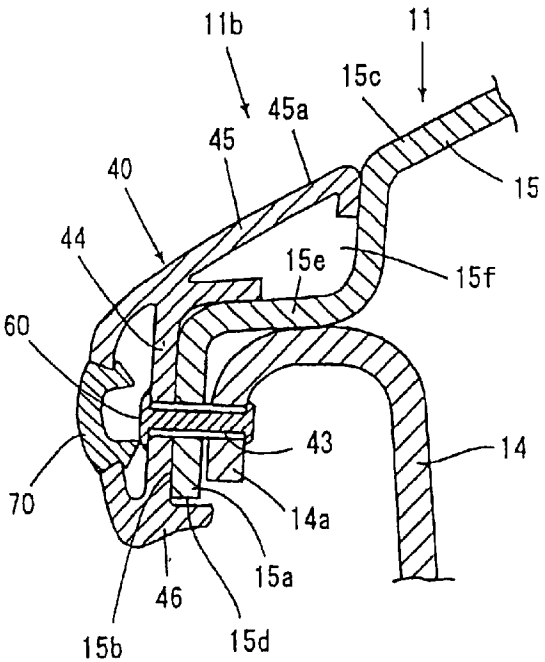

FIGS. 4(*a*) and 4(*b*) are cross sectional views showing the integrated structure of the peripheral edges of the hull 14 and the deck 15 at different locations. FIG. 4*a*, for example, is a partial cross sectional view at the rear portion 11*a* of the vessel body, and FIG. 4(*b*) is a partial cross sectional view showing the front portion 11*b* of the vessel body.

As shown, the vessel body 11 is constructed by joining (for example, adhering with adhesive agent or the like) the hull 14 and the deck 15 at the peripheral regions 14*a*, 15*a* thereof, placing the protector strip 40 (FIG. 1 to FIG. 3) circumferentially thereof, then integrating, or joining, the protector strip 40 and the peripheral regions 14*a*, 15*a* of the hull and the deck with self-tapping screws 50 (FIG. 4(*a*)) or rivets 60 (FIG. 4(*b*)).

The head portions of the self-tapping screws 50 or the rivets 60 are concealed by a cover 70 that extends across an outwardly open channel of the protector strip 40.

Figure 5B:
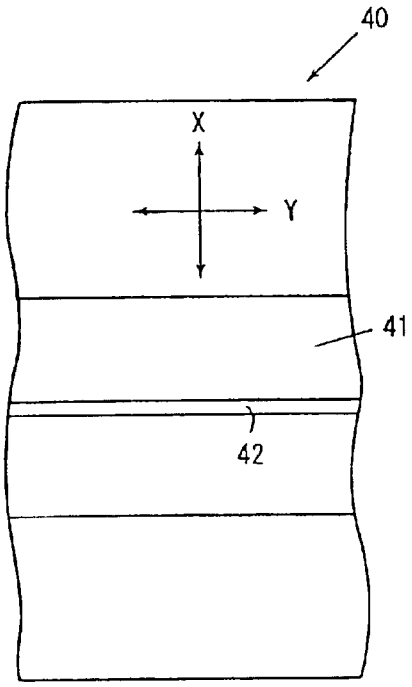
FIG. 5(*a*) is a cross sectional view of a portion of the protector strip, corresponding to the portion shown in FIG. 4(*a*)
Figure 5A:
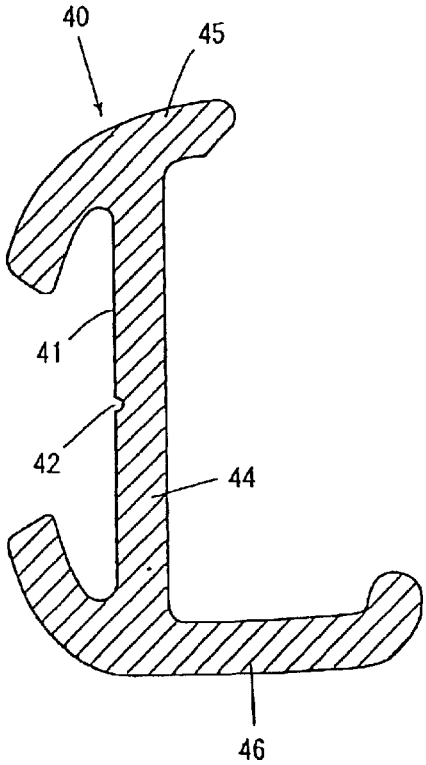
Figure 5C:
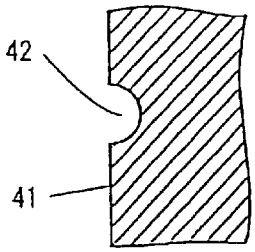

As shown in FIG. 5, the outer surface 41 of the protector strip 40 is formed with a positioning groove 42 for the self-tapping screws 50 or the rivets 60 along the length thereof (in the direction of the arrow Y in FIG. 5(*b*)). The protector strip 40 is formed of extruded material, and the positioning groove 42 is formed simultaneously with extrusion. The protector strip 40 is formed of synthetic resin, for example of PVCF (soft polyvinyl chloride) of hardness about 90.

When a self-tapping screw 50 is used for integrating the protector strip 40 and the peripheral edges 14*a*, 15*a* of the hull and the deck, it can be simply driven with the tip 51 thereof (FIG. 4(*a*)) pressed into the positioning groove 42 at the appropriate positions in the direction shown by the arrow Y (for example by registering visually), and when a rivet (FIG. 4(*b*)) is used, the tip of a drilling tool (a drill or the like) is placed in the positioning groove 42 at the appropriate positions in the direction shown by the arrow Y, openings (holes extending through the protector strip 40 and the peripheral edges 14*a*, 15*a* of the hull and the deck) 43 for driving the rivets are formed, and then the rivets 60 are driven through these openings 43.

As shown in FIG. 4 and FIG. 5, the protector strip 40 comprises a first abutment portion (abutment plate) 44, or wall, that abuts against the outer surface of the peripheral regions 14*a*, 15*a* of the hull and the deck (in this case, the outer periphery 15*b* of the deck 15), a second abutment portion 45, or wall, that is formed integrally with the first abutment portion 44 and abuts against the surface 15*c* of the deck 15, and a cover portion 46, or wall, formed integrally with the first abutment portion 44 for covering at least the peripheral edge 15*d* of the deck 15, and formed with a positioning groove 42 on the outer surface 41 of the first abutment portion 44.

The protector strip 40 differs in cross section at different portions on the periphery of the vessel body 11 (FIGS. 4(*a*), 4(*b*)), as noted earlier; as shown in FIG. 4(*a*), the cover 46 is adapted to cover not only the peripheral edge 15*d* of the deck 15 but also the peripheral edge 14*d* of the hull 14 at the portions where self-tapping screws 50 are used.

As shown in FIG. 4(*b*) for example, the second abutment portion 45 of the protector strip 40 is adapted to cover a recessed portion 15*f*, resulting from the formation of projection 15*e*, which is formed on the deck 15 for increasing joint strength (strength against the impact) between the hull 14 and the deck 15, such as at the front end portion 11*b* of the vessel body 11. At this location, the second abutment potion 45 of the protector strip 40 is adapted so that the surface 45*a* is flush with the surface 15*c* of the deck 15.

In a small water craft 10 constructed as described, the following benefits are realized.

Since the vessel body 11 is formed by joining the hull 14 and the deck 15 at their peripheral regions 14*a*, 15*a* with respect to each other, placing the protector strip 40 circumferentially thereof, and integrating the protector strip 40 and the peripheral regions 14*a*, 15*a* of the hull and the deck with the self-tapping screws 50 or the rivets 60, the joint between the hull 14 and the deck 15 can be strengthened, and the protector strip 40 can be attached with a small number of steps.

Figure 6A:
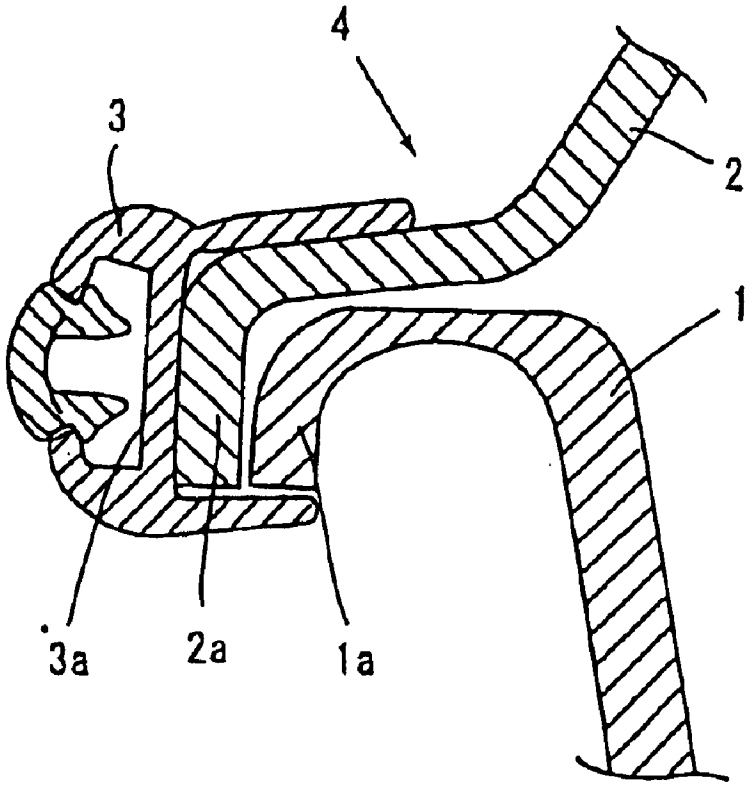
FIG. 6(a) (prior art)
FIG. 6(*a*) shows a prior art construction of a water craft body.
Figure 6B:
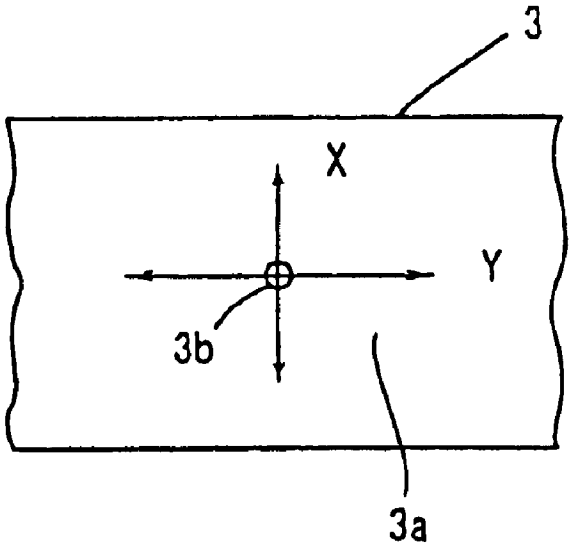
FIG. 6(b) (prior art)

Since the protector strip 40 is formed with a positioning groove 42 for the self-tapping screws 50 or the rivets 60 on the outer surface 41 thereof along the length thereof, the locations for the self-tapping screws 50 or the rivets 60 can be determined on the protector strip 40 by the smaller number of steps than is the case when the positioning holes (3*b* in FIG. 6(*b*)) for the self-tapping screws 50 or the rivets 60 are made without the benefit of the positioning groove.

In other words, using protector strip 40, locations for the self-tapping screws 50 or the rivets 60 can be determined simply along the length of positioning groove 42.

Though simply forming the positioning groove 42 along the length of the protector strip 40 (in the direction shown by the arrow Y in FIG. 5(*b*)) does not ensure high accuracy of the intervals (distances between the adjacent self-tapping screws 50 or rivets 60) of the self-tapping screws 50 or the rivets 60 driven on the protector strip 40 along the length thereof, the accuracy of the intervals of the self-tapping screws 50 or the rivets 60 along the length thereof will not be a significant problem in terms of the construction of the vessel body, and thus they may be driven while registering visually.

However, high positional accuracy of the positioning means for the self-tapping screws 50 or the rivets 60 is required in the direction of the width (the direction of the arrow X in FIG. 5(*b*)) of the protector strip 40, because the desired joint strength cannot be obtained when the self-tapping screws 50 or the rivets 60 are driven at the positions too close to the edges 14*d*, 15*d* of the hull 14 and the deck 15.

On the other hand, using the protector strip 40 of the present invention, the widthwise positions to drive the self-tapping screws 50 or the rivets 60 can be set out with a high degree of accuracy, and thus a desired joint strength can be obtained.

As described thus far, according to the small craft thus constructed, the joint between the hull 14 and the deck 15 can be enhanced, and simultaneously, the protector strip 40 can be attached by a small numbers of steps, and furthermore, the locations for the self-tapping screws 50 or the rivets 60 can be determined or marked on the protector strip 40 by a small number of steps.

(b) since the protector strip 40 is formed of extruded material, the positioning groove 42 can be formed simultaneously with extrusion. Therefore, it is not necessary to form the positioning groove for the self-tapping screws 50 or the rivets 60 after manufacturing of the protector strip 40.

Though one embodiment of the present invention has been described above, the present invention is not limited thereto, and is possible to be modified within the broader scope of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A water craft body including (1) a hull of sheet material bounded by a peripheral edge, (2) a deck of sheet material bounded by a peripheral edge and joined to the hull to form a peripheral joint about the hull and the deck and (3) a protector strip applied to the peripheral joint, and wherein:

peripheral regions of the hull and the deck adjacent to the peripheral edges confront and engage each other at the peripheral joint;

a first wall of the protector strip confronts and engages a peripheral region of one of the hull and the deck;

a second wall of the protector strip overlies at least one of the peripheral edges of the hull and the deck;

the protector strip includes an outwardly opening channel;

a positioning groove is provided in the first wall of the protector strip on the side thereof that faces away from the peripheral region of one of the hull and the deck, the positioning groove being located in a surface of the first wall at an inner side of the channel; and fasteners located in the positioning groove extend through the protector strip and through the peripheral regions of the hull and the deck at intervals along the peripheral joint.

2. A water craft body as recited in claim 1, wherein the peripheral regions of the hull and the deck adjacent to the peripheral edges are joined by an adhesive.

3. A water craft body as recited in claim 1, wherein the fasteners are self-tapping screws.

4. A water craft body as recited in claim 1, wherein the fasteners are rivets.

5. A water craft body as recited in claim 1, wherein the protector strip includes a third wall that engages an outer surface of the deck and forms generally an extension of the outer surface of the deck.

6. A water craft body as recited in claim 1, wherein:

a cover strip is positioned across the outer side of the channel.

7. A water craft body as recited in claim 1, wherein the protector strip is extruded.

8. A method of forming a water craft body comprising the steps of:

(a) providing a hull of sheet material bounded by a peripheral edge;

(b) providing a deck of sheet material bounded by a peripheral edge;

(c) joining peripheral regions of the hull and the deck adjacent to the peripheral edges to each other to form a peripheral joint;

(d) providing a protector strip including a first wall, a second wall, an outwardly opening channel and a positioning groove located in a surface of the first wall at an inner side of the channel;

(e) applying the protector strip to the peripheral joint so that (1) the first wall of the protector strip confronts and engages a peripheral region of one of the hull and the deck, (2) the second wall of the protector strip overlies at least one of the peripheral edges of the hull and the deck and (3) the positioning groove faces away from the peripheral region of one of the hull and the deck;

(f) locating fasteners in the positioning groove at intervals along the peripheral joint; and (g) installing the fasteners through the protector strip and through the peripheral regions of the hull and the deck at the intervals along the peripheral joint.

9. The method as recited in claim 8, and further comprising the step of:

joining the peripheral regions of the hull and the deck adjacent to the peripheral edges by an adhesive prior to step (g).

10. The method as recited in claim 8, wherein the fasteners are self-tapping screws that are driven through the protector strip and through the peripheral regions of the hull and the deck.

11. The method as recited in claim 8, where in prior to step (f), openings, located at intervals along the positioning groove, are formed through the protector strip and through the peripheral regions of the hull and the deck; and in step (g), the fasteners are installed through the openings.

12. The method as recited in claim 8, wherein the protector strip additionally includes a third wall, and, in step (e) the protector strip is applied to the peripheral joint so that the third wall that engages an outer surface of the deck and forms generally an extension of the outer surface of the deck.

13. The method as recited in claim 8, wherein, following step (g), a cover strip is positioned across the outer side of the channel.

14. The method as recited in claim 8, wherein the protector strip is formed by an extrusion process.

15. The method as recited in claim 14, wherein the positioning groove is formed during the extrusion process.

* * * * *